US008449210B2

(12) United States Patent
Noguchi

(10) Patent No.: US 8,449,210 B2
(45) Date of Patent: May 28, 2013

(54) DRAWER MECHANISM AND IMAGE FORMING APPARATUS EQUIPPED WITH THE SAME

(75) Inventor: Youhei Noguchi, Osaka (JP)

(73) Assignee: Kyocera Mita Corporation (JP)

( * ) Notice: Subject to any disclaimer, the term of this patent is extended or adjusted under 35 U.S.C. 154(b) by 1255 days.

(21) Appl. No.: 12/101,232

(22) Filed: Apr. 11, 2008

(65) Prior Publication Data

US 2008/0260443 A1 Oct. 23, 2008

(30) Foreign Application Priority Data

Apr. 20, 2007 (JP) ..... 2007-112039

(51) Int. Cl.
*B41J 29/02* (2006.01)

(52) U.S. Cl.
USPC ..... 400/692

(58) Field of Classification Search
USPC ..... 400/692
See application file for complete search history.

(56) References Cited

U.S. PATENT DOCUMENTS

| | | | | |
|---|---|---|---|---|
| 6,115,568 | A * | 9/2000 | Sameshima | 399/110 |
| 2001/0054863 | A1 * | 12/2001 | Uchino et al. | 312/334.12 |
| 2006/0137137 | A1 * | 6/2006 | Hoshide et al. | 16/96 R |

FOREIGN PATENT DOCUMENTS

| | | |
|---|---|---|
| CN | 2255627 Y | 6/1997 |
| JP | 6-149015 | 5/1994 |
| JP | 9-240849 | 9/1997 |
| JP | 2001-173305 | 6/2001 |
| JP | 2003232348 | 8/2003 |

* cited by examiner

*Primary Examiner* — Daniel Hess
*Assistant Examiner* — David Tardif
(74) *Attorney, Agent, or Firm* — Gerald E. Hespos; Michael J. Porco; Matthew T. Hespos

(57) ABSTRACT

A drawer mechanism includes a plate-shaped frame, a first roller and a second roller disposed in a rotatable manner on a surface of the frame at a specific interval, and a rail movable between a first state where the rail is mounted on the surface of the frame and a second state where the rail is pulled out from the frame in a predetermined pull-out direction. Each roller includes a guide peripheral surface formed in an outer peripheral portion in a radial direction and a lower surface opposing the surface of the frame at a specific interval. The rail includes a first pinched portion and a second pinched portion extending linearly in the pull-out direction and pinched between the surface of the frame and one of the lower surfaces and the guide peripheral surfaces of the first roller and the second roller, respectively.

8 Claims, 16 Drawing Sheets

DRAWER MECHANISM AND IMAGE FORMING APPARATUS EQUIPPED WITH THE SAME

BACKGROUND OF THE INVENTION

1. Field of the Invention

The present invention relates to a drawer mechanism that allows units to be pulled out from a certain apparatus main body and to an image forming apparatus equipped with the same.

2. Description of the Related Art

An image forming apparatus, such as a copying machine, is often configured in such a manner that respective units can be pulled out in order to facilitate maintenance. Units that can be pulled out include a paper feeding cassette, a primary paper feeding unit, an intermediate feed unit, a developing unit, a drum unit, a toner container, and a discharge unit. During paper jam processing or at the occurrence of empty toner or empty paper, the user is able to carry out the task by pulling out the corresponding unit. Various types have been proposed regarding the mechanism that allows units to be pulled out, of which a typical mechanism adopting a rail will now be described by way of example.

According to the slide rail disclosed in JP-A-2001-173305 (D1), an outer rail is fixed to the interior of the housing of a copying machine while an inner rail is attached in such a manner that it can be pulled out and pushed in by sliding it along the outer rail. The end edges of the inner rail are received in a space between rollers attached to an overhanging portion of the outer rail. A roller attached to a tapered portion of the inner rail fits in a space between the end edges of the outer rail. The both rails are thus combined without wobbling and the inner rail is rendered slidable.

JP-A-9-240849 (D2) discloses an image forming apparatus having a paper feeding tray that can be pulled out, a guide rail for the paper feeding tray, and a rotatable guide roller provided to the guide rail on the front side. In this apparatus, a hole in which the guide roller falls when the paper feeding tray is set in the apparatus main body at the predetermined position is made in the guide surface of the paper feeding tray.

JP-A-6-149015 (D3) discloses a corona discharger formed of a coroner discharger main body opposing the photosensitive body and a guide rail that supports the discharger main body in an attachable and detachable manner. The guide rail is a member having a U-shaped cross section, and it has plural pairs of guide protrusions on the mutually opposing inner walls. The corona charger main body is formed of a casing having an almost U-shaped cross section and a corona wire stretched across the interior of the casing. The corona discharger main body can be attached by inserting guided portions that protrude sideways from the both side walls of the casing into attachment spaces defined between the guide protrusions inside the guide rail. In addition, a distance from the corona discharger to the photosensitive body can be changed by choosing the attachment spaces.

According to the apparatus of D1, it is configured in such a manner that the outer rail is fixed to the copying machine main body and the inner rail is allowed to slide along the outer rail. This configuration requires both the outer rail and the inner rail. Hence, the number of components is large and the cost and the weight are increased.

According to the apparatus of D2, it is configured in such a manner that the guide rail is fixed to the copying machine main body and the sliding plate provided to the paper feeding tray is allowed to slide along the guide rail. This configuration requires both the guide rail and the sliding plate. Hence, as with the apparatus of D1, the number of components is large and the cost and the weight are increased.

According to the apparatus of D3, the drawer mechanism is formed by engagement of the guide rail and the casing without using any roller, and larger resistance is generated when a unit is pulled out. Hence, this configuration is not preferable for a drawer mechanism adopted in an image forming apparatus because the respective units therein are heavy components and resistance load becomes larger.

SUMMARY OF THE INVENTION

An object of the invention is to provide a drawer mechanism that is made compact and reduces the fabrication manhours, the number of components, and the cost while making the resistance load smaller. Another object is to provide an image forming apparatus equipped with this drawer mechanism.

A drawer mechanism according to one aspect of the invention that achieves the above and other objects includes: a plate-shaped frame; a first roller and a second roller disposed in a rotatable manner on a surface of the frame at a specific interval, each roller including a guide peripheral surface formed in an outer peripheral portion in a radial direction and a lower surface opposing the surface of the frame at a specific interval; and a rail movable between a first state where the rail is mounted on the surface of the frame and a second state where the rail is pulled out from the frame in a predetermined pull-out direction, the rail including a first pinched portion and a second pinched portion extending linearly in the pull-out direction and pinched between the surface of the frame and one of the lower surfaces and the guide peripheral surfaces of the first roller and the second roller, respectively.

Also, an image forming apparatus according to another aspect of the invention includes: an apparatus main body having a housing structure and equipped with a plate-shaped frame; a unit accommodated in the apparatus main body; and a drawer mechanism that allows the unit to be pulled out from the apparatus main body. The drawer mechanism has the configuration described above.

DETAILED DESCRIPTION OF THE PREFERRED EMBODIMENTS

Hereinafter, one embodiment of the invention will be described in detail with reference to the drawings.

Figure 1:
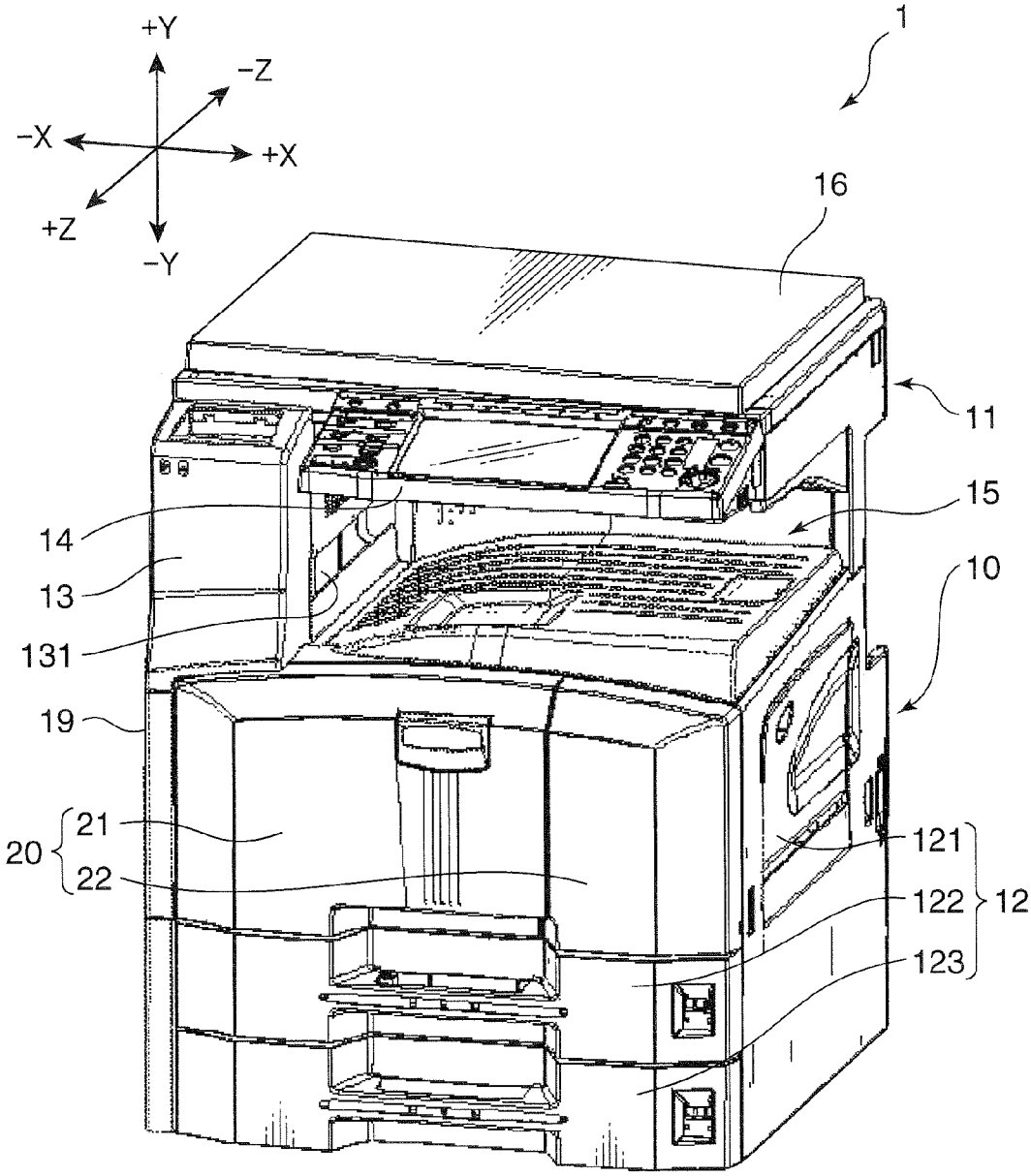
FIG. 1 is an outward perspective view of an image forming apparatus according to one embodiment of the invention.
Figure 2:
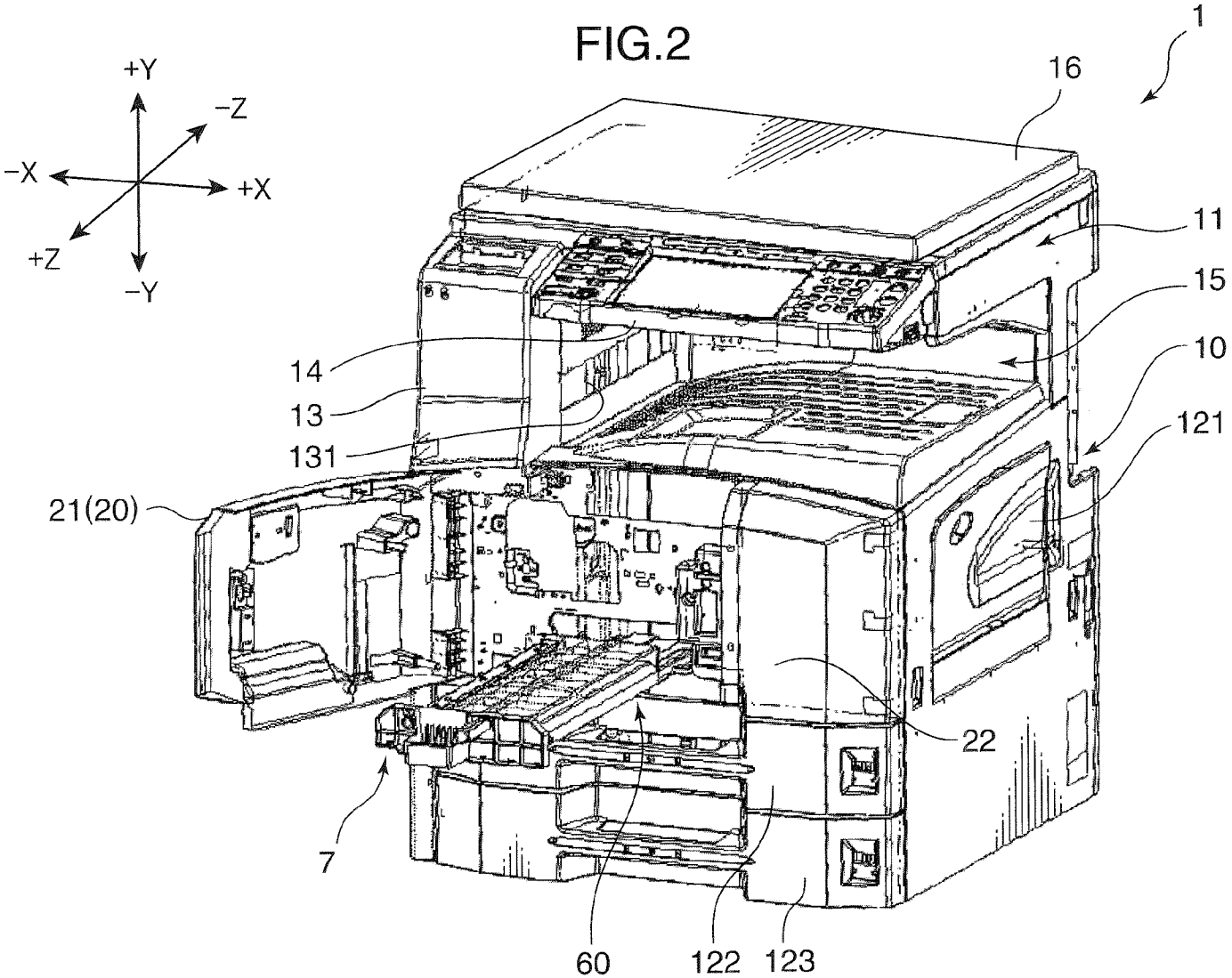
FIG. 2 is an outward perspective view of the image forming apparatus showing a state where a front cover is open and a paper feeding unit is pulled out.

FIG. 1 is a perspective view showing the outward appearance of an image forming apparatus 1 according to one embodiment of the invention. FIG. 2 is also an outward perspective view of the image forming apparatus 1 showing a state where a front cover 20 is open and a paper feeding unit 7 is pulled out. In these drawings, the X direction is referred to as the right-left direction (+X is the right and −X is the left), the Y direction is referred to as the top-bottom direction (+Y is the top and −Y is the bottom), and the Z direction is referred to as the front-rear direction (+Z is the front and the −Z is the rear).

The image forming apparatus 1 is a copying machine of a so-called body-inside paper discharging type, and it includes an apparatus main body 10, a scanner unit 11 disposed above the apparatus main body 10, and a paper discharging portion 15 disposed between the apparatus main body 10 and the scanner unit 11.

The apparatus main body 10 accommodates various mechanisms for enabling image formation (described below with reference to FIG. 3). An exterior package 19 of the apparatus main body 10 forms an outer body of the apparatus main body 10, and plays a role of a casing accommodating various mechanisms that the apparatus main body 10 has for enabling image formation. A manual paper feeding tray 121 is provided to the apparatus main body 10 on the right side face. Also, two paper feeding cassettes 122 and 123 aligned in the top-bottom direction are provided to the apparatus main body 10 on the front face in an attachable and detachable manner.

The front cover 20 is provided above the paper feeding cassettes 122 and 123 on the front face of the apparatus main body 10. The front cover 20 is formed of a left cover 21 and a right cover 22 that are allowed to open and close about the hinged supports, which are the left end side and the right end side, respectively. FIG. 2 shows a state where the left cover 21 of the front cover 20 is open. By opening the front cover 20 (left cover 21), the paper feeding unit 7 mounted on a drawer mechanism 60 described below can be pulled out forward.

The scanner unit 11 optically reads an image on a document to be copied and includes a housing structure. A contact glass on which is placed a document is fit in the upper surface thereof. Although the illustration is omitted in the drawing, the housing accommodates therein a light source, a reflection mirror, a movable carriage on which the light source and the mirror are mounted, an image-forming lens group that forms a reflected light image of the document, a photo-electric conversion element (line-type CCD or the like) that generates an electric signal by subjecting the reflected light image to photo-electric conversion, and so forth. The scanner unit 11 is supported on a supporting column portion 13 provided to stand at the upper left end face of the apparatus main body 10 and a frame provided to stand on the rear end side of the apparatus main body 10.

An operation panel 14 is attached to the front edge of the scanner unit 11. The operation panel 14 includes various operation buttons, a numerical keypad, and a liquid crystal display panel, and accepts information about various operations from the user. A pressing panel 16 is attached to the scanner unit 11 on the upper surface side. The pressing panel 16 is openable and closable, and it is opened when a document is placed on the contact glass and closed after the document is placed thereon so as to press the document. It should be noted that an automatic document feeder (ADF) may be attached instead of the pressing panel 16. FIG. 3, which will be described below, shows an example where an ADF 16A is attached onto the scanner unit 11.

The paper discharging portion 15 is a portion where a recording sheet fed from the paper feeding cassette 122 or 123 or the manual paper feeding tray 121 is discharged after image forming processing is applied thereon in the apparatus main body 10. A paper discharge opening 131, through which a recording sheet is discharged to the paper discharging portion 15, is made in the right side wall of the supporting column portion 13.

Figure 3:
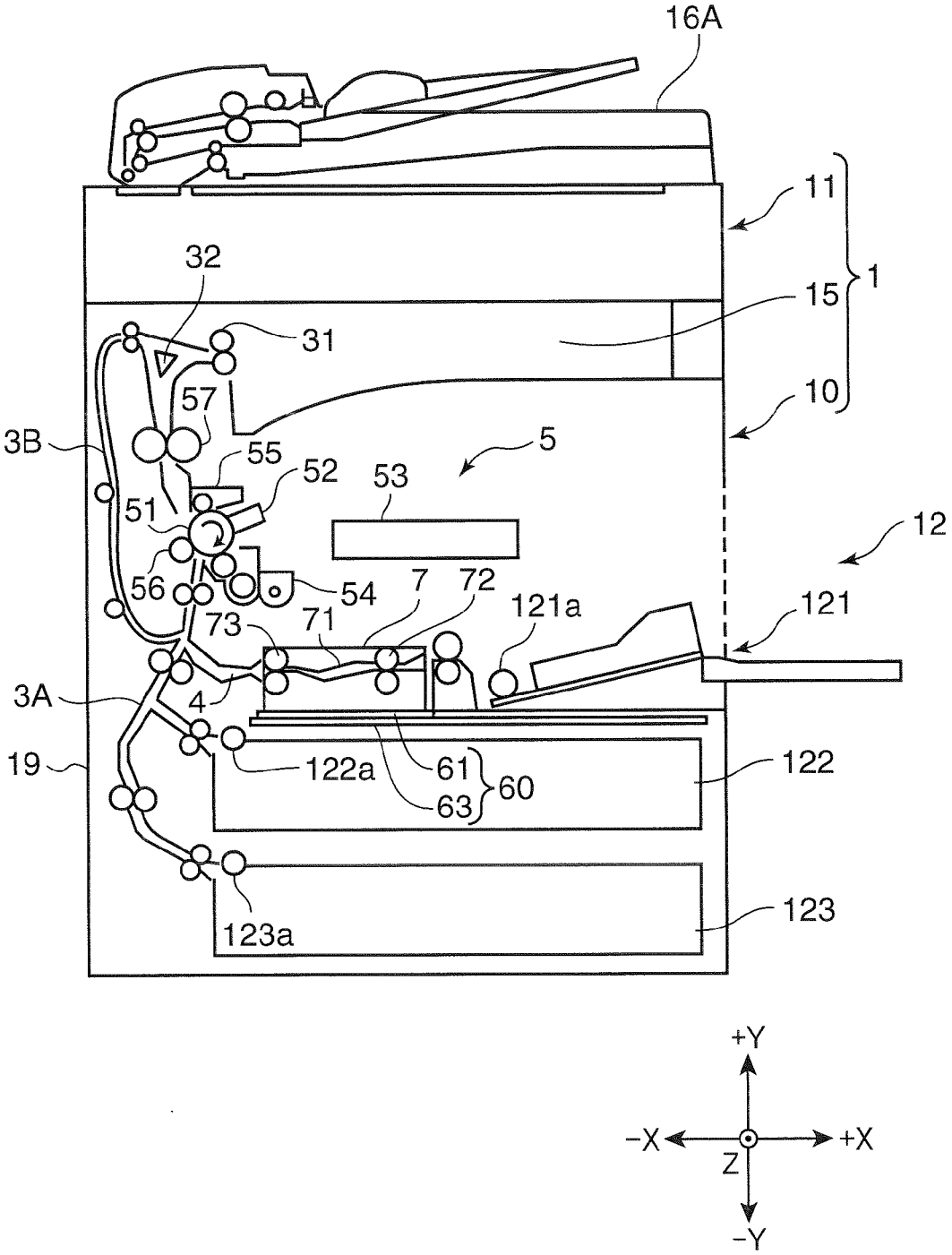
FIG. 3 is a sectional front view showing the inner configuration of the image forming apparatus.

FIG. 3 is a cross section showing the internal structure of the apparatus main body 10. The apparatus main body 10 includes a simplex printing transportation path 3A, a duplex printing transportation path 3B, a manual paper transportation path 4, a paper feeding portion 12, an image forming portion 5, a fixing portion 57, and a discharge roller pair 31. It further includes the paper feeding unit 7 and the drawer mechanism 60 that allows the paper feeding unit 7 to be pulled out forward.

The paper feeding portion 12 includes the manual paper feeding tray 121 to feed a recording sheet manually and the paper feeding cassettes 122 and 123 to automatically feed a recording sheet. The manual paper feeding tray 121 is supported in a rotatable manner at the lower end portion on the right side wall of the apparatus main body 10. It is normally closed and opened when in use. FIG. 3 shows a state where the manual paper feeding tray 121 is open. Recording sheets placed on the manual paper feeding tray 121 are taken out one by one by a pick-up roller 121*a* and sent toward the paper feeding unit 7 on the downstream side.

Figure 8:
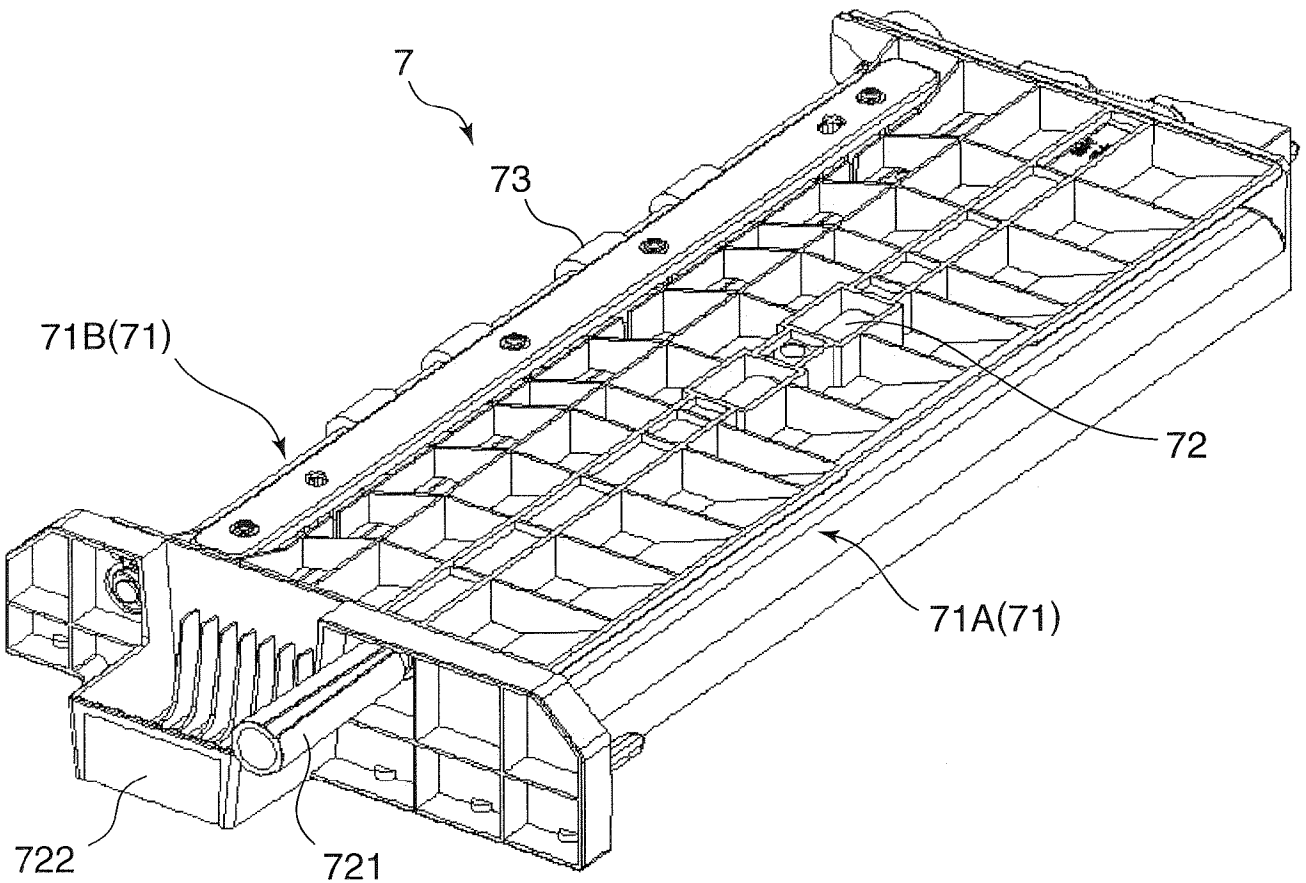
FIG. 8 is a perspective view of the paper feeding unit mounted on the drawer mechanism.

Although it will be described in detail with reference to FIGS. 8 and 9 below, the paper feeding unit 7 includes an internal passage 71 through which a recording sheet is passed, and a first roller pair 72 and a second roller pair 73 that transport a recording sheet passing through the internal passage 71. The paper feeding unit 7 is mounted on a rail 61 in such a manner that it can slide thereon in the front-rear direction. Likewise, the rail 61 is mounted on a plate-shaped frame 63 provided inside the apparatus main body 10 in such a manner that it can slide thereon in the front-rear direction. Detailed description in this regard will be given below.

A recording sheet transported to the paper feeding unit 7 is transported into the simplex printing transportation path 3A by way of the manual paper transportation path 4 located downstream of the paper feeding unit 7. The recording sheet is then headed for the image forming portion 5.

Each of the paper feeding cassettes 122 and 123 stores a large number of recording sheets. The recording sheets are taken out one by one, respectively, by pick-up rollers 122*a* and 123*a* located at the sending outlets, and transported into the lower portion of the simplex printing transportation path 3A. The recording sheet is then headed for the image forming portion 5.

The simplex printing transportation path 3A is connected, at the lower portion, to the paper feeding cassettes 122 and 123 and the manual paper transportation path 4 of the paper feeding portion 12. The simplex printing transportation path 3A is extended upward almost perpendicularly from the portion connected to the paper feeding portion 12 to the paper discharge portion 15. The recording sheet thus transported from the paper feeding portion 12 is transported upward to the paper discharge portion 15 along the simplex printing transportation path 3A. The image forming portion 5 and the fixing portion 57 are provided sequentially to the simplex printing transportation path 3A along the recording sheet transportation direction.

The image forming portion 5 applies processing to transfer a toner image of the document image on a recording sheet transported into the image forming portion 5 through the simplex printing transportation path 3A. The image forming portion 5 includes a photosensitive drum 51, a charger 52, a laser beam emitting portion 53, a developing portion 54, a cleaning unit 55, and a transfer roller 56.

The photosensitive drum 51 rotates about its rotation shaft and carries an electrostatic latent image and a toner image of the document image on the peripheral surface thereof. The charger 52 applies a high voltage to the photosensitive drum 51 so as to charge the peripheral surface of the photosensitive drum 51 homogeneously. The laser beam emitting portion 53 forms an electrostatic latent image of the document image on the peripheral surface of the photosensitive drum 51 by irradiating a laser beam according to image data of the document image read by the scanner unit 11 to the charged peripheral surface of the photosensitive drum 51. The developing portion 54 forms a toner image according to the document image on the peripheral surface of the photosensitive drum 51 by developing the electrostatic latent image. The transfer roller 56 forms a nip portion together with the photosensitive drum 51 for transferring the toner image onto a recording sheet. The cleaning unit 55 removes toner particles remaining on the peripheral surface of the photosensitive drum 51 after the toner image was transferred. The toner image is transferred onto the recording sheet in the nip portion while the recording sheet is transported through the simplex printing transportation path 3A.

The fixing portion 57 fixes the transferred toner image onto the recording sheet by heating the recording sheet, which is passed through the simplex printing transportation path 3A and on which the toner image is formed in the image forming portion 5.

The discharge roller pair 31 is provided to a position downstream of the fixing portion 57 in the simplex printing transportation path 3A and corresponding to the paper discharge opening 131 made in the supporting column portion 13. The discharge roller pair 31 discharges a recording sheet to the paper discharge portion 15 or switches it back into the duplex printing transportation path 3B. When a recording sheet is to be discharged to the paper discharge portion 15, the discharge roller pair 31 is driven in a forward direction for introducing the recording sheet to the paper discharging portion 15 from the simplex printing transportation path 3A. On the other hand, when a recording sheet is to be switched back into the duplex printing transportation path 3B, the discharge roller pair 31 sends a recording sheet that has been driven in the forward direction toward the paper discharge portion 15 by a predetermined length and is then stopped in a state where it nips the recording sheet. Subsequently, the discharge roller pair 31 is driven in an inverse direction. The recording sheet is thus switched back into the duplex printing paper transportation path 3B.

A discharge branching guide 32 is provided in the simplex printing paper path 3A between the fixing portion 57 and the discharge roller pair 31. The top end side of the duplex printing transportation path 3B is connected to the simplex printing transportation path 3A at the position at which the discharge branching guide 32 is disposed. The discharge branching guide 32 introduces a recording sheet transported through the fixing portion 57 to the discharge roller pair 31. Meanwhile, when the discharge roller pair 31 sends the recording sheet backward to the position of the discharge roller pair 31 by switching back the recording sheet, the posture of the discharge branching guide 32 is switched for allowing the recording sheet that has been sent backward to be headed for the duplex printing transportation path 3B.

The apparatus main body 10 executes simplex printing by performing a simplex printing sequence as follows using the respective components shown in FIG. 3 as described above. Initially, a recording sheet, on which an image is to be formed, is transported into the simplex printing transportation path 3A from any one of the paper feeding cassettes 122 and 123 and the manual paper feeding tray 121 and passed through the image forming portion 5 and the fixing portion 57 sequentially. When the recording sheet is passed through the nip portion in the image forming portion 5, a toner image corresponding to the original image of the document read by the scanner unit 11 is transferred thereon. The recording sheet bearing the transferred toner image is heated when it is passed through the fixing portion 57 located downstream of the image forming portion 5. The transferred toner image is fixed onto the recording sheet by this heating. The recording sheet onto which is fixed the toner image is transported to the position of the discharge roller pair 31 as it is introduced by the discharge branching guide 32. Accordingly, the recording sheet, on which the image of the original image on one surface of the document is formed, is discharged to the paper discharge portion 15 by the discharge roller pair 31.

In the case of duplex printing, the image is formed on the main surface of the recording sheet in the same manner as in the simplex printing sequence as described above. The recording sheet is then reversed via the duplex printing transportation path 3B and returned to a position of the simplex printing transportation path 3A, which is located upstream of the image forming portion 5. After the image forming processing and the fixing processing are applied on the back surface of the recording sheet, the recording sheet is discharged to the paper discharge portion 15.

The image forming apparatus 1 as described above is configured in such a manner that the respective units can be pulled out in order to facilitate paper jam processing, replenishment of consumable goods, and maintenance. Units that can be pulled out include the paper feeing unit 7, the paper feeding cassettes 122 and 123, a developing unit including the developing portion 54, a drum unit formed of the photosensitive drum 51 and so forth, a toner container (not shown), and a discharge unit formed of the discharge roller pair 31 and so forth. During paper jam processing, at the occurrence of empty toner or empty paper, or at the routine checkup, the user or the service person pulls out the corresponding unit from the apparatus main body 10 and puts the unit back into the apparatus main body 10 after a certain task is completed. As the mechanism that allows these units to be pulled out and put in back, the drawer mechanism of the invention is applicable. In this embodiment, as is shown in FIG. 2, the drawer mechanism 60 applied to pull out the paper feeding unit 7 will be described by way of example.

Figure 4:
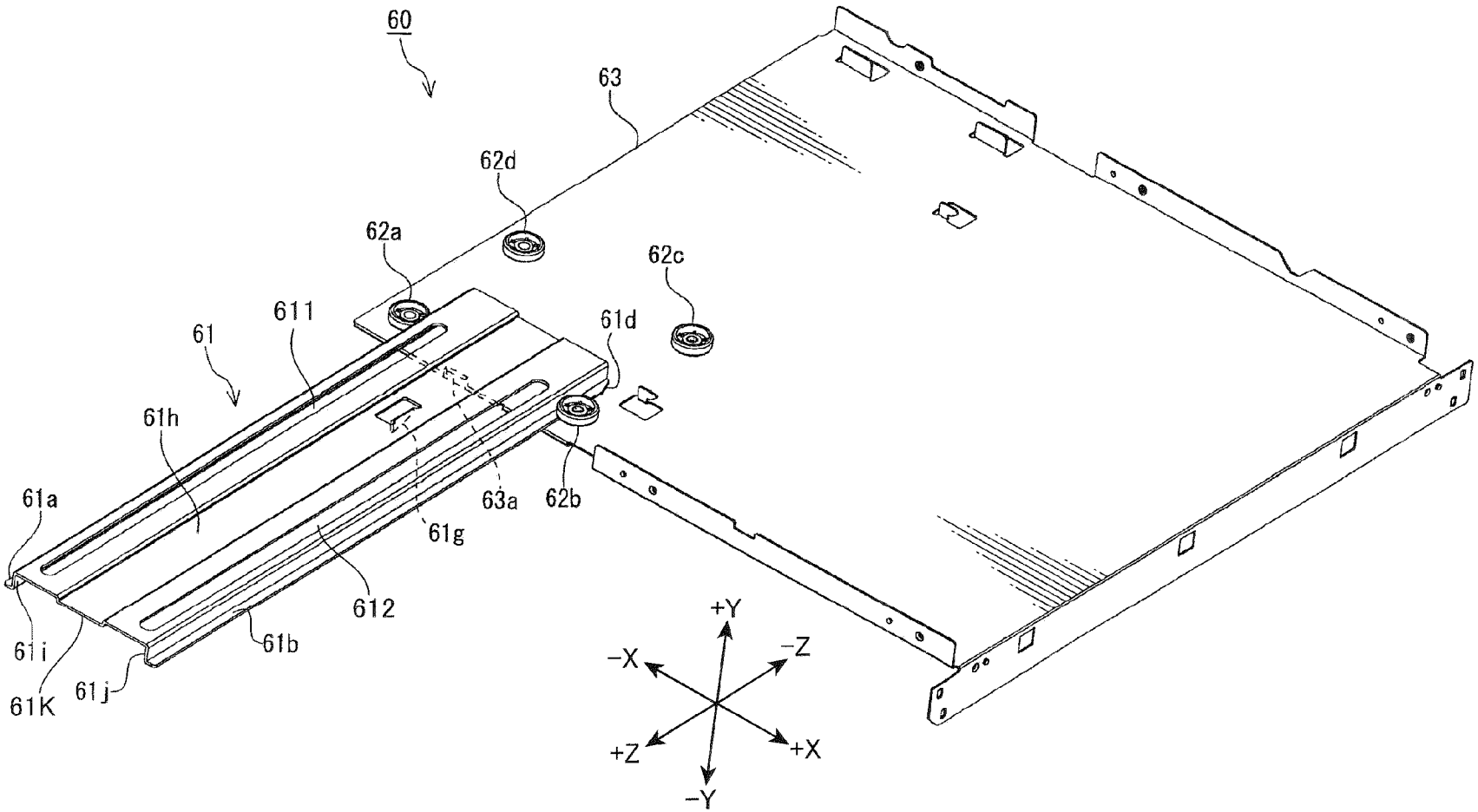
FIG. 4 is a perspective view of a drawer mechanism.
Figure 5:
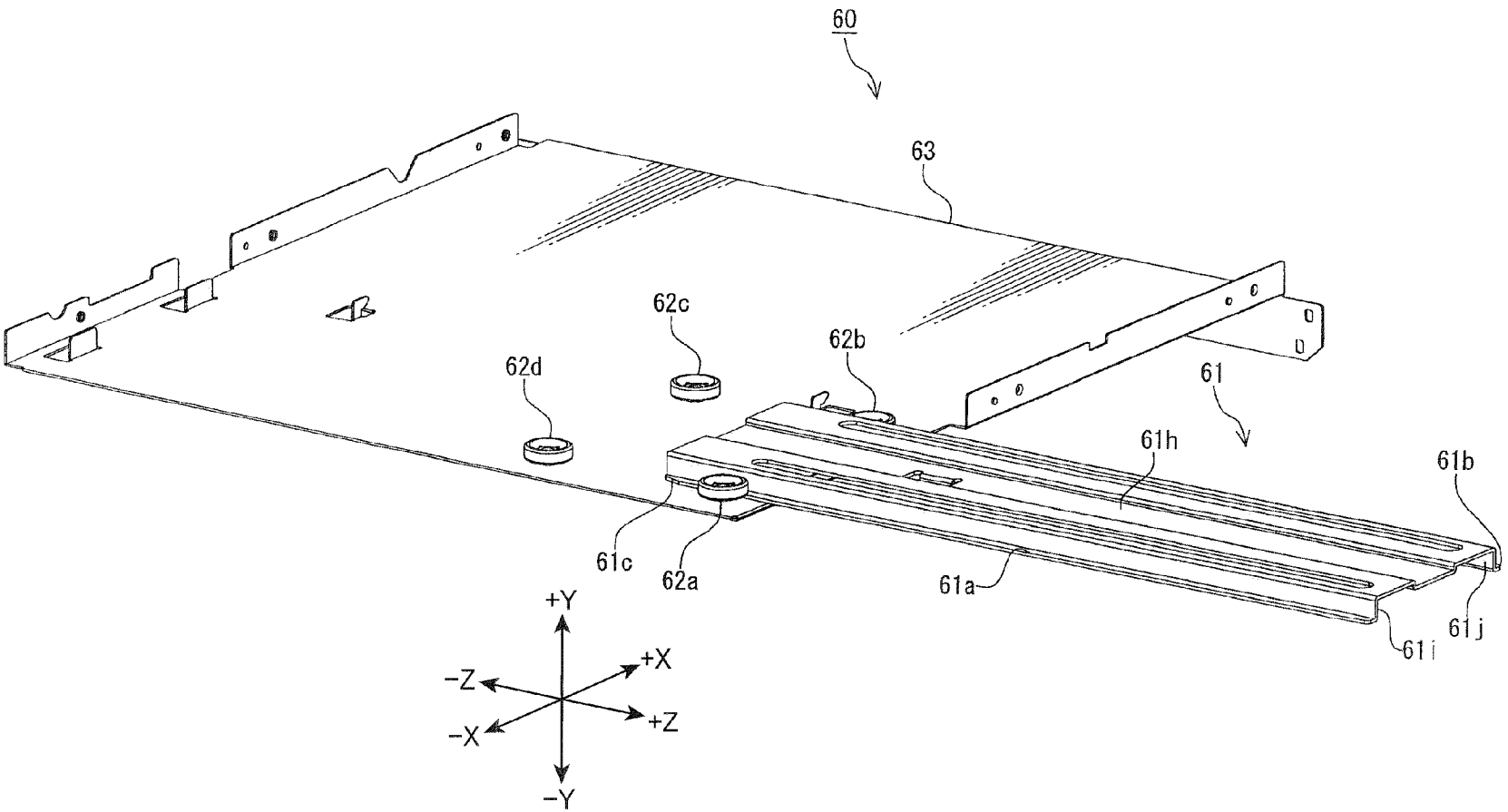
FIG. 5 is a perspective view of the drawer mechanism when viewed in a direction different from the direction in FIG. 4.
Figure 6:
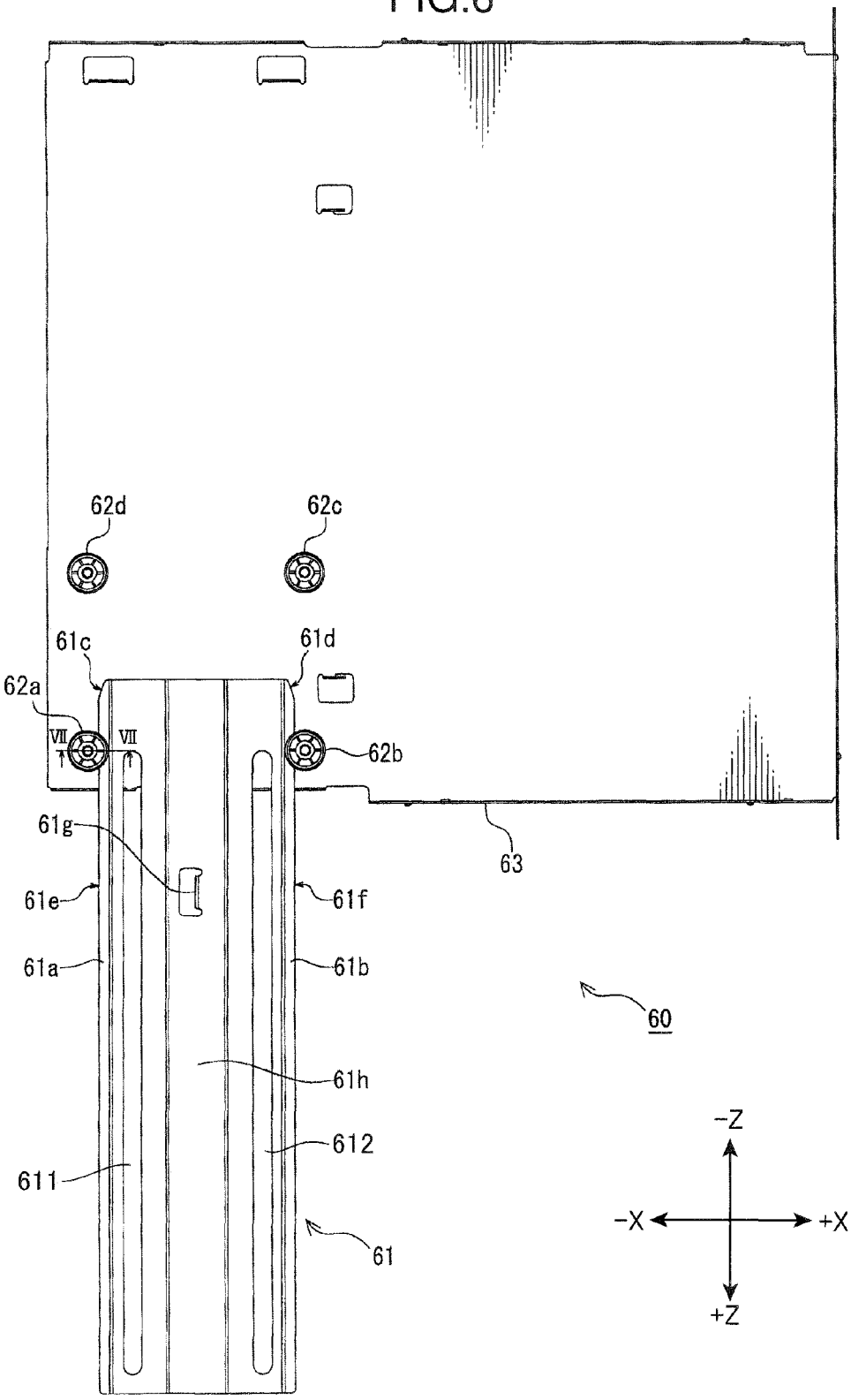
FIG. 6 is a plan view of the drawer mechanism.
Figure 7:
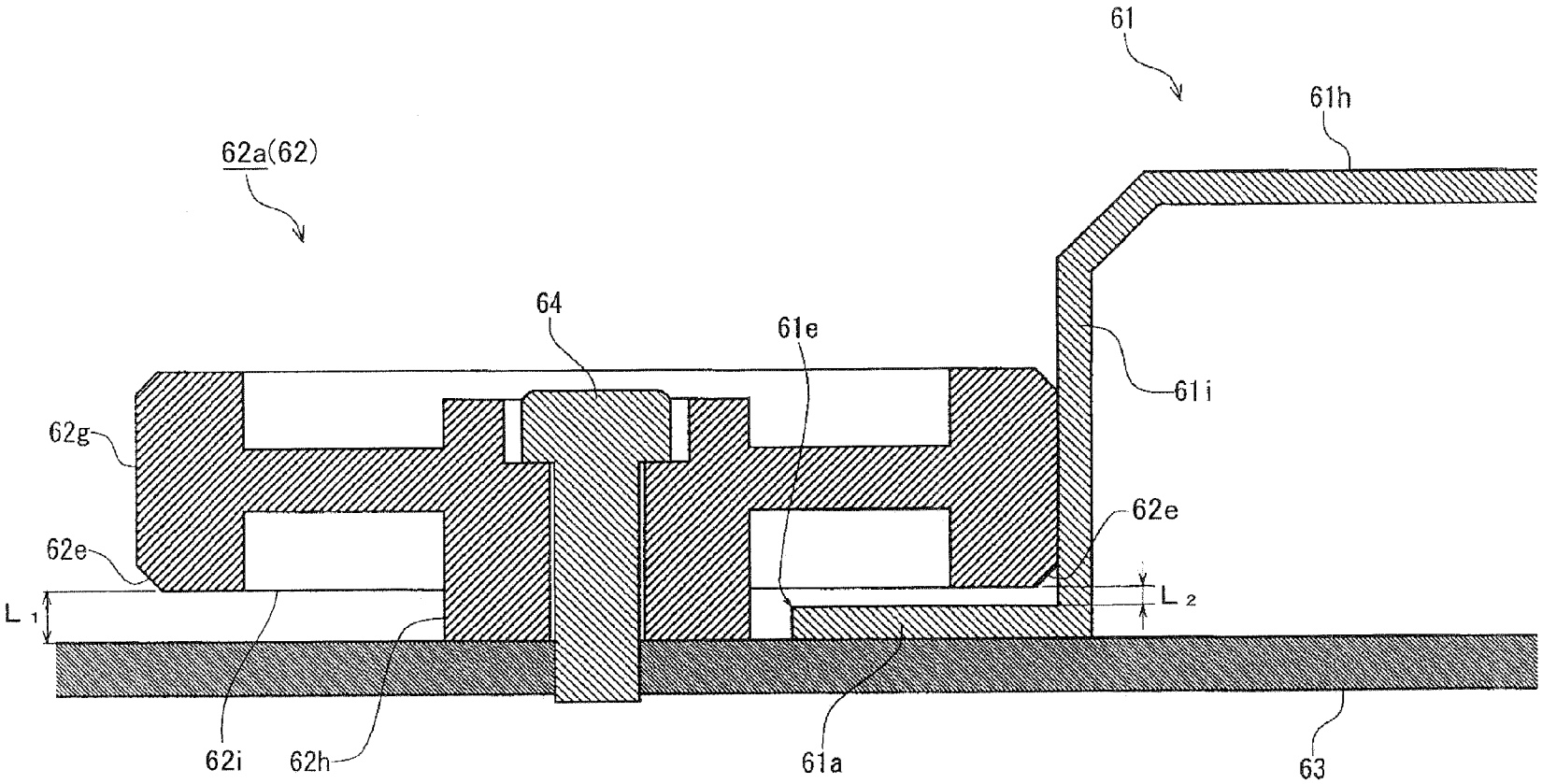
FIG. 7 is a cross section taken on line VII-VII of FIG. 6.

FIG. 4 is a perspective view of the drawer mechanism 60. FIG. 5 is a perspective view of the drawer mechanism 60 when viewed in a direction different from the direction of FIG. 4. FIG. 6 is a plan view of the drawer mechanism 60. FIG. 7 is a cross section taken on line VII-VII of FIG. 6. The X, Y, and Z directions in FIG. 4 through FIG. 6 are indicated in the same manner as in FIG. 1 and FIG. 2.

The drawer mechanism 60 includes the plate-shaped frame 63 bridged across the apparatus main body 10 in the right-left direction, the rail 61 disposed on the surface of the frame 63 and on which the paper feeding unit 7 is mounted, and four rollers 62*a* through 62*d* (referred to collectively as the rollers 62) disposed in a rotatable manner on the surface of the frame 63 at specific intervals. Herein, a steel plate member, such as iron, can be used as the rail 61 and the frame 63. A resin member, such as POM (polyoxymethylene (polyacetal)), can be used as the rollers 62.

The rail 61 is a plate-shaped member of an oblong shape when viewed in a plane, and has a pair of side edge portions in the longitudinal direction (first side edge portion and second side edge portion) parallel to the front-rear direction, that is, the pull-out direction. Also, the side edge portions in the longitudinal direction of the plate-shaped member are bent downward so that the cross section of the rail 61 taken along the widthwise direction is almost shaped like a capital U. The rail 61 thus bent includes a top plate 61*h* to serve as a mount surface for the paper feeding unit 7, side plates 61*i* and 61*j* (first guided surface and second guided surface) formed by bending both the side portions in the longitudinal direction of the top plate 61*h* almost at right angles to form mountain fold, flanges 61*a* and 61*b* (first pinched portion and second pinched portion) formed by bending the lower end portions of the side plates 61*i* and 61*j* along the longitudinal direction almost at right angles to form valley fold for the side plates 61*i* and 61*j* to further protrude sideways.

Each of the side plates 61*i* and 61*j* and the flanges 61*a* and 61*b* is a strip-shaped portion extending linearly in the pull-out direction of the rail 61. The side plates 61*i* and 61*j* are almost perpendicular with respect to the surface of the frame 63. The flanges 61*a* and 61*b* are almost parallel with respect to the surface of the frame 63.

In order to ensure the strength, a shallow groove 61*k* is made by means of bending in the top plate 61*h* at the center in the longitudinal direction. Guide grooves 611 and 612 (guide portions) extending along the pull-out direction are formed on the both side portions of the groove 61*k*. The guide grooves 611 and 612 are long holes perforated in the top plate 61*h*, and pin members 613 integral with the paper feeding unit 7 described below are fit therein so that they can move by sliding.

The rollers 62 are toroidal members when viewed in a plane, and each includes a rotation shaft 62*h* formed at the center position in the radial direction, an outer peripheral surface 62*g* (guide peripheral surface) formed in the outer peripheral portion in the radial direction, and a lower surface 62*i* opposing the surface of the frame 63 at a specific interval (see FIG. 7). The rotation shaft 62*h* is provided with a through-hole extending in the axial center direction, and a screw 64 is loose-fit in the through-hole. The screw 64 is threaded into the surface of the frame 63 in a perpendicular direction with respect to the surface of the frame 63 while penetrating through the through-hole. Accordingly, the rollers 62 are fixed onto the surface of the frame 63 in a rotatable manner about the screws 64.

This embodiment shows an example where four rollers 62*a* 62*b*, 62*c*, and 62*d* are disposed on the frame 63. To be more specific, two rollers 62*a* and 62*d* (first roller) are disposed on the side of the left side edge portion of the rail 61, and the other two rollers 62*b* and 62*c* (second roller) are disposed on the side of the right side edge portion of the rail 61. The rollers 62*a* and 62*d* and the rollers 62*b* and 62*c* are aligned along the pull-out direction and disposed in such a manner so as to pinch the rail 61 from the right and left side edge portions thereof.

The rail 61 is allowed to move by sliding between a first state where it is mounted on the surface of the frame 63 and a second state where it is pulled out in the front direction from the frame 63. FIG. 4 through FIG. 6 show a state where the rail 61 is being attached between the rollers 62*a* and 62*d* and the rollers 62*b* and 62*c* on the frame 63. The second state is a state where the rear end side of the rail 61 is positioned slightly behind the position at which the rollers 62*c* and 62*d* are disposed (see FIG. 11). Meanwhile, the first state is a state where the front edge of the frame 63 and the front end side of the rail 61 almost coincide with each other. The movement by sliding of the rail 61 as described above is supported by the rollers 62.

More specifically, as is shown in FIG. 7, the flange 61*a* on the left side of the rail 61 is pinched in a clearance between the lower surface 62*i* of the roller 62*a* and the surface of the frame 63 and the outer peripheral surface 62*g* of the roller 62*a* abuts on the side plate 61*i* on the left side of the rail 61. The roller 62*d* is configured in the same manner. Meanwhile, the flange 61*b* on the right side of the rail 61 is pinched in clearances between the lower surfaces 62*i* of the respective rollers 62*b* and 62*c* and the surface of the frame 63, and the outer peripheral surfaces 62*g* of the rollers 62*b* and 62*c* abut on the side plate 61*j* on the right side of the rail 61. The outer peripheral surfaces 62*g* and the side plates 61*i* and 61*j* slide relatively with respect to each other by rotations of the rollers 62. In this manner, the rail 61 is supported on the rollers 62 in a slidable manner while being prevented from falling off.

By using the rollers 62 for allowing the rail 61 to slide, it is possible to make the resistance load during the sliding action smaller. In addition, because it is configured in such a manner that the flanges 61*a* and 61*b* are pinched by using the lower surfaces 62*i* of the rollers 62, it is possible to use the rollers 62 auxiliary for positioning the rail 61 when the rail 61 is inserted between the rollers 62. Further, because the side plates 61*i* and 61*j* of the rail 61 are pinched between the outer peripheral surfaces 62*g* of the rollers 62, the rail 61 is guided in the pull-out direction by rotations of the rollers 62.

Each of the rollers 62 is attached to the frame 63 so as to have a clearance $L_1$ (see FIG. 7) larger than the thickness of the flange 61*a* (61*b*) between the lower surface 62*i* and the surface of the frame 63, and the flange 61*a* (61*b*) is inserted into this clearance $L_1$. The clearance $L_1$ is defined by the length of the rotation shaft 62*h* protruding below the lower surface 62*i* of the roller 62. Because a space above the flange 61*a* (61*b*) is covered by the bottom surface 62*i* of the roller 62 in this manner, the rail 61 will not fall off in the $L_1$ direction (in the top direction).

A clearance $L_2$ in the $L_1$ direction between the upper surface of the flange 61*a* (61*b*) and the lower surface 62*i* of the roller 62 is preferably a distance selected from a range of 0.1 to 0.3 mm. By setting the clearance $L_2$ in this range, it is possible to allow the rail 61 to slide smoothly by suppressing wobbling of the rail 61 in the $L_2$ direction.

Notches 61*c* and 61*d* are made in the rail 61 on the rear end side, that is, they are made, respectively, in the tip portions of the flanges 61*a* and 61*b* when the rail 61 is inserted into the clearance $L_1$. By providing the notches 61*c* and 61*d*, it becomes easier to insert the rail 61 between the rollers 62.

The outer peripheral corners 62*e* of the lower surface 62*i* of the roller 62 (see FIG. 7) are chamfered. By chamfering the outer peripheral corners 62*e*, it becomes easier to insert the rail 61 into the clearance $L_1$. It should be noted that by chamfering the corners 61*e* and 61*f* of the upper surfaces of the flanges 61*a* and 61*b*, respectively, it becomes easier to insert the rail 61 into the clearance $L_1$, too.

As is shown in FIG. 4, a protrusion 63*a* (first protrusion) is provided to stand on the surface of the frame 63. Also, the rail 61 is provided with a fall-off preventing protrusion 61*g* (second protrusion) that is locked by interference with the protrusion 63*a* of the frame 63 when the rail 61 is pulled out. The protrusion 63*a* and the fall-off preventing protrusion 61*g* can be formed readily by cutting and raising the corresponding parts by means of steel metal processing.

When the rail 61 is to be inserted between the bottom surfaces 62*i* of the rollers 62 and the frame 63, the rail 61 is inserted from diagonally above so that the fall-off preventing protrusion 61*g* will not interfere against the protrusion 63*a*. When the rail 61 is pulled out (second state), the fall-off preventing protrusion 61*g* interferes against the protrusion 63*a* so that the rail 61 will not be pulled out any further in preventing the rail 61 from falling off. When the rail 61 needs to be pulled out completely, it is pulled out diagonally above in the same manner when it is inserted.

The drawer mechanism 60 configured as described above allows the paper feeding unit 7 to be pulled out from the apparatus main body 10. The paper feeding unit 7 is mounted on the top plate 61*h* of the rail 61 so that it can be moved by sliding in the pull-out direction (front-rear direction) of the rail 61. FIG. 8 is a perspective view of the paper feeding unit 7. FIG. 9 is a perspective view of the paper feeding unit 7 on the bottom surface side showing a state when mounted on the rail 61. FIG. 10 is a cross section taken on line X-X of FIG. 9.

The paper feeding unit 7 includes an incoming transportation portion 71A on the upstream side in the recording sheet transportation direction in the internal passage 71 and an outgoing transportation portion 71B on the downstream side. The incoming transportation portion 71A receives a recording sheet from the manual feeding tray 121. The outgoing transportation portion 71B sends out a recording sheet into the manual paper transportation path 4. A recording sheet is transported through the internal passage 71 by rotations of the first roller pair 72 and the second roller pair 73. An operation shaft 721 and a handle 722 are provided to the paper feeding unit 7 on the front end side in a protruding manner. The operation shaft 721 is a member that is integrally rotatable with one roller shaft of the first roller pair 72. In the event of a paper jam in the internal passage 71, the user is able to remove a jammed sheet from the outgoing transportation portion 71B by manually rotating the operation shaft 721. The handle 722 is a portion that is held when the paper feeding unit 7 is pulled out.

Figure 9:
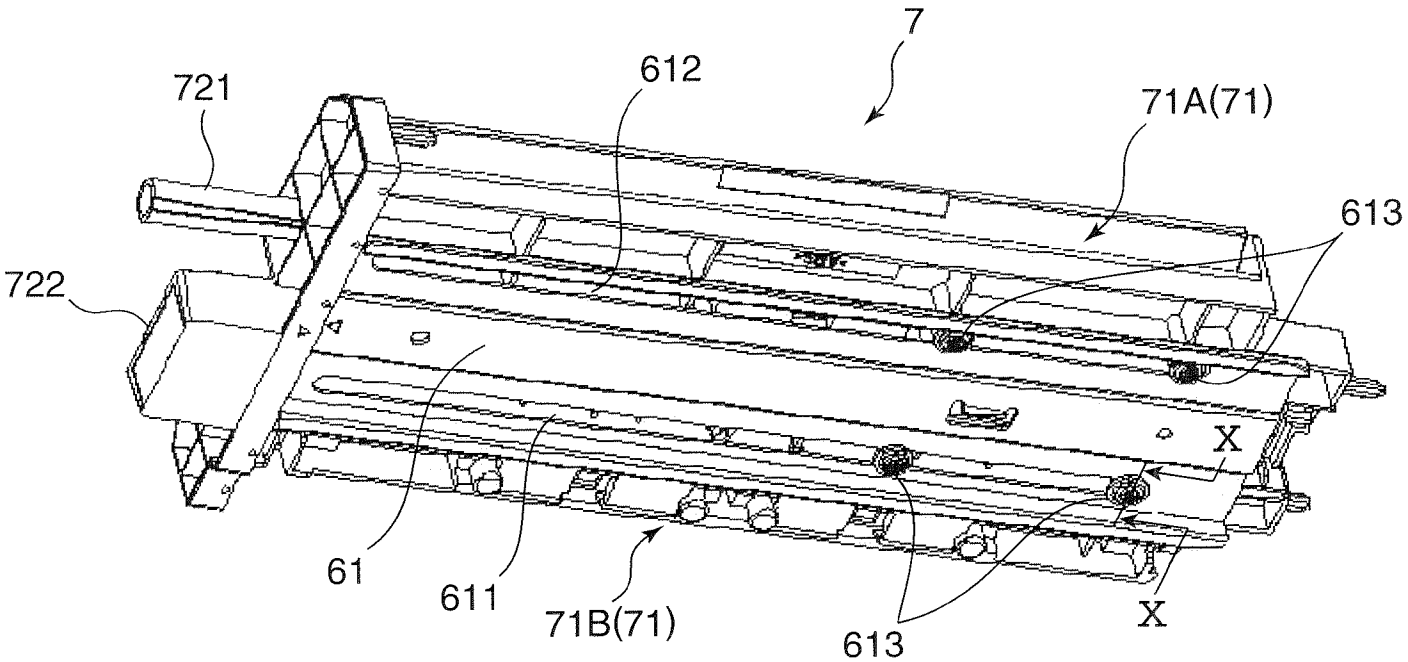
FIG. 9 is a perspective view of the paper feeding unit on the bottom surface side.
Figure 10:
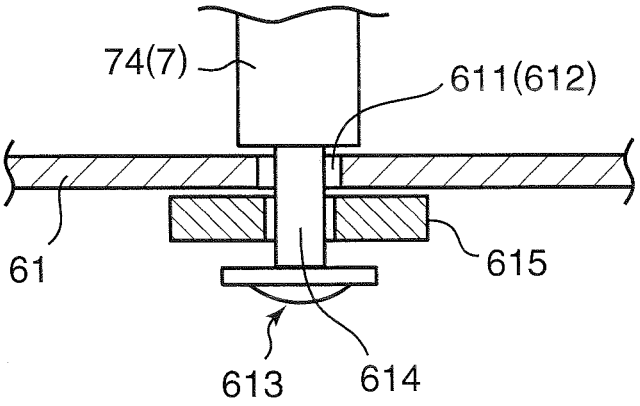
FIG. 10 is a cross section taken on line X-X of FIG. 9.

As is shown in FIG. 9, four pin members 613 are attached to the bottom surface of the paper feeding unit 7. More specifically, as is shown in FIG. 10, each pin member 613 is threaded into a boss portion 74 via a resin ring 615 in a state where it penetrates through the guide groove 611 (612) made in the rail 61. The boss portions 74 are members provided integrally with the bottom surface of the paper feeding unit 7 in a protruding manner and having screw holes. A body portion 614 of the pin member 613 is allowed to move by sliding along the guide groove 611 (612) while it is prevented from falling off with the pin head and the resin ring 615.

The four pin members 613 are attached in such a manner that they are aligned two by two in the pull-out direction. An interval between the two in the left line and the two in the right line is equal to an interval between the left and right guide grooves 611 and 612. The two pin members 613 in the left line and those in the right line are fit in the guide grooves 611 and 612, respectively. In addition, the two pin members 613 in each of the left line and the right line are attached at a specific interval in the front-rear direction. The interval in the front-rear direction determines an amount of protrusion of the paper feeding unit 7 from the rail 61.

Figure 11:
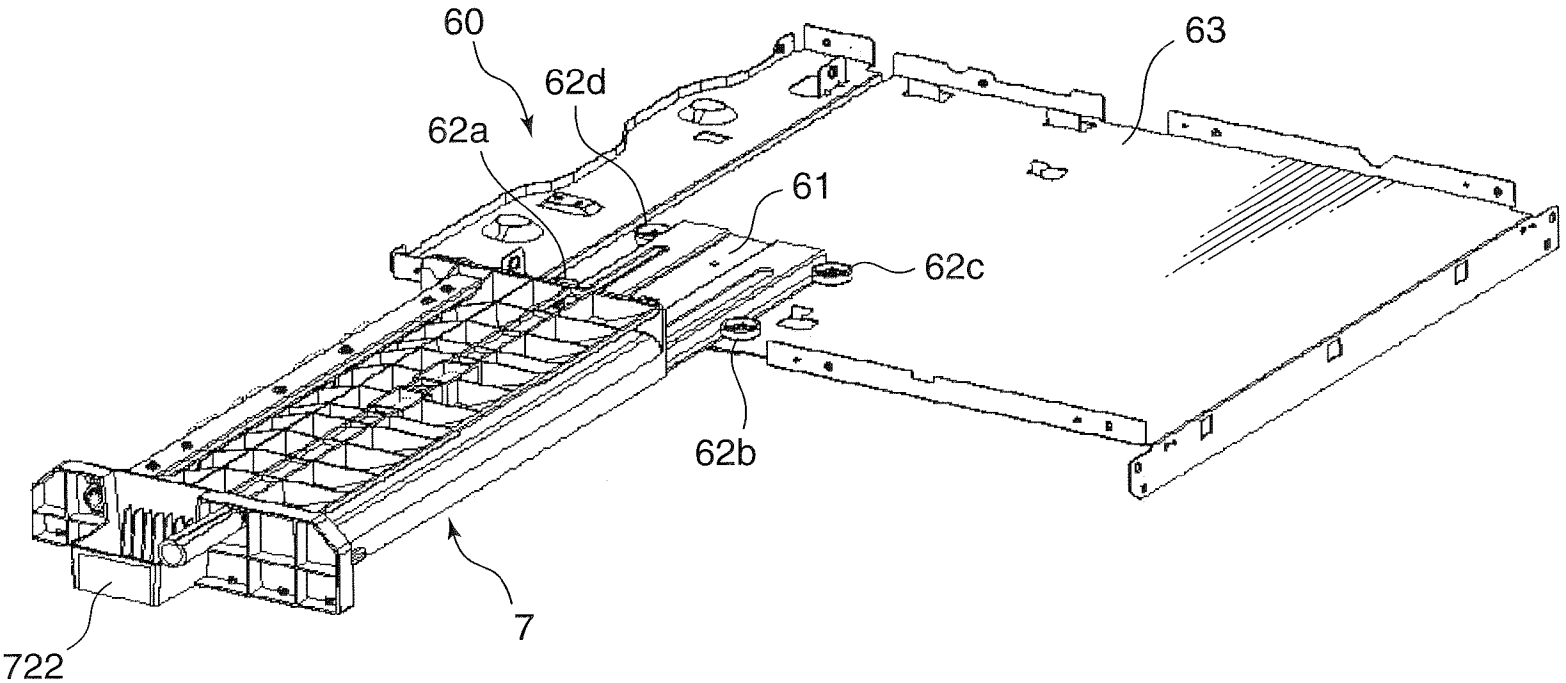
FIG. 11 is a perspective view showing a state where the paper feeding unit mounted on the drawer mechanism is pulled out.
Figure 12:
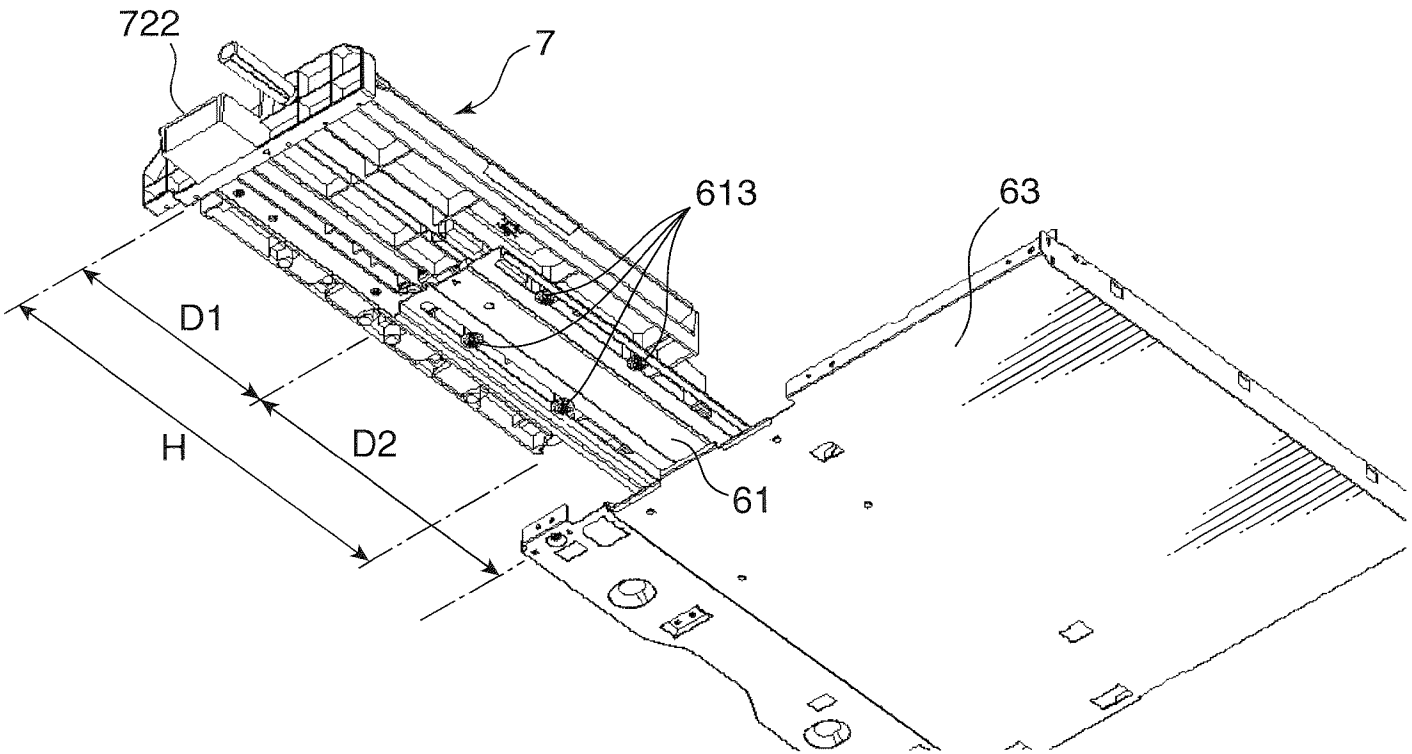
FIG. 12 is a perspective view when the state of FIG. 11 is viewed from the back surface side.

FIG. 11 is a perspective view showing a state where the paper feeding unit 7 mounted on the drawer mechanism 60 is pulled out. FIG. 12 is a perspective view when the state of FIG. 11 is viewed from the back surface side. As is shown in FIG. 12, the paper feeding unit 7 is allowed to move by sliding so that it protrudes in the front direction by a distance D1 (first distance) with respect to the rail 61 as the pin members 613 are guided by the guide grooves 611 and 612. Also, the rail 61 is allowed to move by sliding so that it protrudes in the front direction by a distance D2 (second distance) with respect to the frame 63. The states of the rail 61 in FIG. 11 and FIG. 12 are the state (second state) where the rail 61 is fully pull out up to the point where the fall-off preventing protrusion 61*g* interferes with the protrusion 63*a*.

When the user is to pull out the paper feeding unit 7, he or she holds the handle 722 and pulls it forward. In this instance, the pin members 613 slide in the guide grooves 611 and 612 first, and the paper feeding unit 7 is pulled out by the distance D1 with respect to the rail 61 (it should be noted that the distance D1 of FIG. 12 does not indicate the maximum amount of pull-out). When the pin members 613 on the front side reach the limit of pull-out as they abut on the front edges of the guide grooves 611 and 612, the rail 61 is subsequently pulled out by the distance D2 with respect to the frame 63. Herein, the distance D1+D2, which is a sum of the distance D1 and the distance D2, is longer than the length H of the paper feeding unit 7 in the pull-out direction. It is thus possible to pull out the paper feeding unit 7 entirely to the outside of the apparatus main body 10.

When the paper feeding unit 7 is pushed in, the paper feeding unit 7 is first pushed in with respect to the rail 61. When the pin members 613 on the rear side abut on the rear edges of the guide grooves 611 and 612, the rail 61 is subsequently pushed in with respect to the frame 63.

As has been described, according to the drawer mechanism 60 provided with the rail 61 and the rollers 62, not only can the rollers 62 make the resistance load smaller, but also they can prevent the rail 61 from falling off in a direction other than the pull-out direction by auxiliary positioning the rail 61 at the time of insertion and guiding the rail 61. It is thus possible to pull out the paper feeding unit 7 easily in a stable manner. Also, because the drawer mechanism 60 does not use an outer rail that has been conventionally used, not only can the number of components and the fabrication man-hours be reduced, but also a contribution can be made to a size reduction of the apparatus.

Description of Modifications

While the embodiment of the invention has been described, it should be appreciated that the invention is not limited to this embodiment. For example, the invention can be modified as described in the following.

(1) The embodiment above described an example where the four rollers 62*a* through 62*d* are attached to the frame 63. The rollers 62 are able to fulfill their role when a total of two rollers 62 are provided on the both sides of the rail 61, one on each side. When four rollers 62 are used as in the embodiment above, however, it is possible to guide or support the rail 61 in a more stable manner. In addition, when five or more rollers 62 are used, the pull-out stability can be further enhanced. The rollers 62 only have to be disposed on the surface of the frame 63, and they may be attached to any other frame member instead of being attached to the frame 63.

Figure 13:
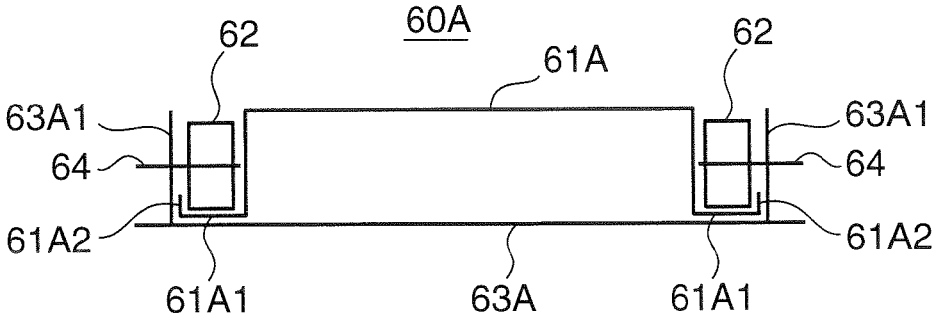
FIG. 13 through FIG. 19 are schematic views showing modifications of the drawer mechanism.

(2) FIG. 13 is a schematic view showing a drawer mechanism 60A according to a first modification. The embodiment above described an example where the rotation shafts 62*h* (screws 64) of the rollers 62 are attached to the frame 63 perpendicularly. In contrast, in the drawer mechanism 60A, a pair of wall surfaces 63A1 perpendicular to a frame 63A is provided, and the rotation shafts (screws 64) of the rollers 62 are attached perpendicularly with respect to the wall surfaces 63A1. Consequently, a direction in which the screws 64 extend as well as the outer peripheral surfaces of the rollers 62 are parallel to the plane of the frame 63A.

The drawer mechanism 60A is characterized in that flanges 61A1 of the rail 61A are pinched between not the lower surfaces of the rollers 62 but the outer peripheral surfaces (guide peripheral surfaces) thereof and the frame 63A. Accordingly, in this drawer mechanism 60A, the flange portions 61A1 of the rail 61A are the guided surfaces and also the pinched portions.

Further, an edge portion 61A2 bent in the top direction is provided to the outer side end portion of each flange 61A1 to make the portions corresponding to the flanges 61A1 in the shape of a groove. Because the flanges 61A1 are pinched as the outer peripheral surfaces of the rollers 62 are accommodated in such groove-shaped portions, the rail 61A is supported in a more reliable manner.

Figure 14:
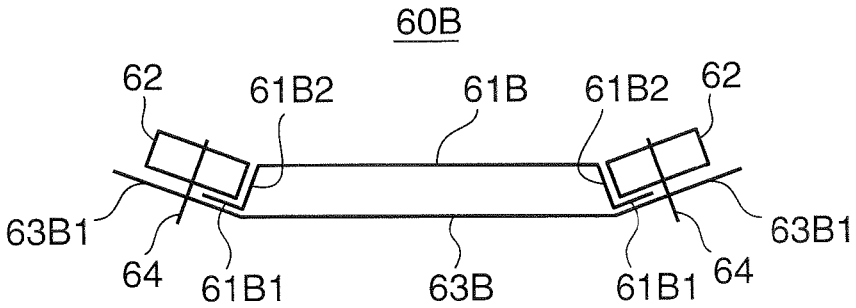

(3) The embodiment above described an example where the surface of the frame 63 to which are attached the rollers 62 is a flat surface. However, the surface to which are attached the rollers 62 may be inclined. FIG. 14 is a schematic view showing a drawer mechanism 60B according to a second modification. The drawer mechanism 60B is of a bowl shape whose frame 63B has a pair of inclined surfaces 63B1. The rotation shafts (screws 64) of the rollers 62 are attached to the inclined surfaces 63B1 perpendicularly. Meanwhile, a rail 61B includes flanges 61B1 having a bending angle along the inclined surfaces 63B1 and side plates 61B2 whose mountain fold angle with respect to the top plate is larger than 90 degrees. Hence, the flanges 61B1 are pinched between the lower surfaces of the rollers 62 and the inclined surfaces 63B1 and the side plates 61B2 are guided as the outer peripheral surfaces of the rollers 62 abut thereon.

Figure 15:
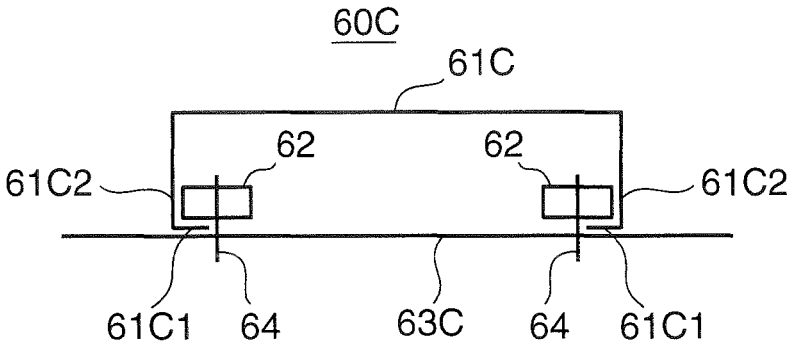

(4) In the embodiment above, the flanges 61*a* and 61*b* are formed so as to protrude outward of the rail 61. However, the flanges may be formed to protrude inward of the rail 61. FIG. 15 is a schematic view showing a drawer mechanism 60C according to a third modification. A rail 61C of the drawer mechanism 60C has flanges 61*c*1 formed by bending the lower ends of both side plates 61C2 almost at right angles in an inward direction. The rollers 62 are disposed on the inner side of the side plates 61C2. Hence, the flanges 61*c*1 are pinched between the lower surfaces of the rollers 62 and a frame 63C and the side plates 61C2 are guided as the outer peripheral surfaces of the rollers 62 abut on the inner side surfaces thereof.

Figure 16:
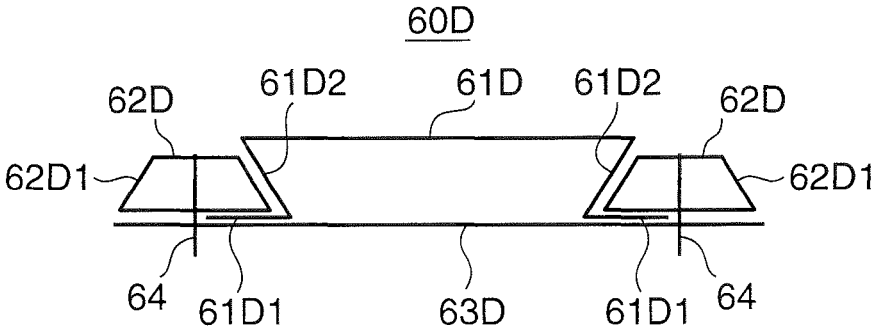

(5) The side plates 61*i* and 61*j* and the flanges 61*a* and 61*b* of the rail 61 are formed by means of bending at right angles in the embodiment above. Although it has been described in the modification of FIG. 14, they may be formed by means of bending at an angle other than right angles to form mountain fold or valley fold. FIG. 16 is a schematic view showing a drawer mechanism 60D according to a fourth modification. A rail 61D of the drawer mechanism 60D includes flanges 61D1 and side plates 61D2 formed by means of bending at angles a cuter than right angles. Rollers 62D have outer peripheral surfaces 62D1 inclined so as to conform to the inclined shape of the side plates 61D2. Hence, the flanges 61D1 are pinched between the lower surfaces of the rollers 62D and a frame 63D and the inclined side plates 61D2 are guided as the inclined outer peripheral surfaces 62D1 of the rollers 62 abut thereon.

Figure 17:
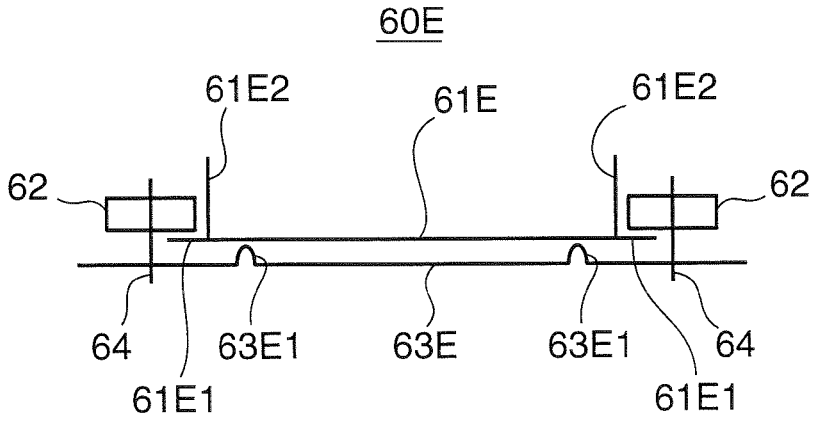

(6) The embodiment above described an example where the rail 61 is formed by bending a plate-shaped member in such a manner that the cross section in the widthwise direction is almost in the shape of a capital U. However, the rail may be formed by welding plate members. FIG. 17 is a schematic view showing a drawer mechanism 60E according to a fifth modification. A rail 61E of the drawer mechanism 60E is formed by providing flat plates that will be made into side plates 61E2 by means of welding to stand perpendicularly in the vicinity of the both end portions of a horizontal flat plate. Lower portions protruding outward from the side plates 61E2 of the horizontal flat plate become portions that play a role of flanges 61E1.

Small ribs 63E1 are provided to stand on the surface of a frame 63E. The ribs 63E1 are to reduce a frictional force between the frame 63E and the rail 61E. Hence, the flanges 61E1 are pinched between the lower surfaces of the rollers 62 and the frame 63E and the side plates 61E2 are guided as the outer peripheral surfaces of the rollers 62 abut thereon.

Figure 18:
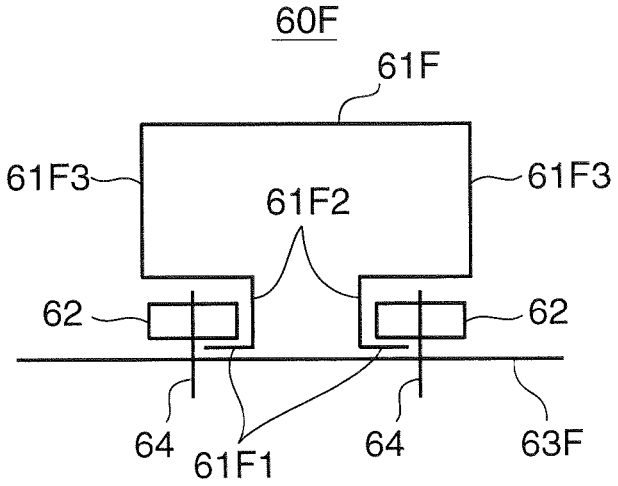

(7) The embodiment above described the thin rail 61 whose thickness in the top-bottom direction is thin by way of example. However, in a case where there is a dimensional margin in the top-bottom direction, it may be a thick rail. FIG. 18 is a schematic view showing a drawer mechanism 60F according to a sixth modification. A rail 61F of the drawer mechanism 60F has a cross section shaped like a Greek letter Omega, "Ω". More specifically, side plates 61F2 are formed by bending perpendicularly the both end portions of a plate member bent so as to have a rectangular cross section, and flanges 61F1 are formed by further bending the end portions of the side plates 61F2 perpendicularly.

The side plates 61F2 are positioned on the inner side than main side plates 61F3 of the rail 61F by an amount almost comparable to the size of the rollers 62. Accordingly, the rollers 62 are accommodated between the main side plates 61F3. Hence, the flanges 61F1 are pinched between the lower surfaces of the rollers 62 and a frame 63F and the side plates 61F2 are guided as the outer peripheral surfaces of the rollers 62 abut thereon. According to the drawer mechanism 60F, it is possible to lessen a region in the horizontal direction occupied by the drawer mechanism.

Figure 19:
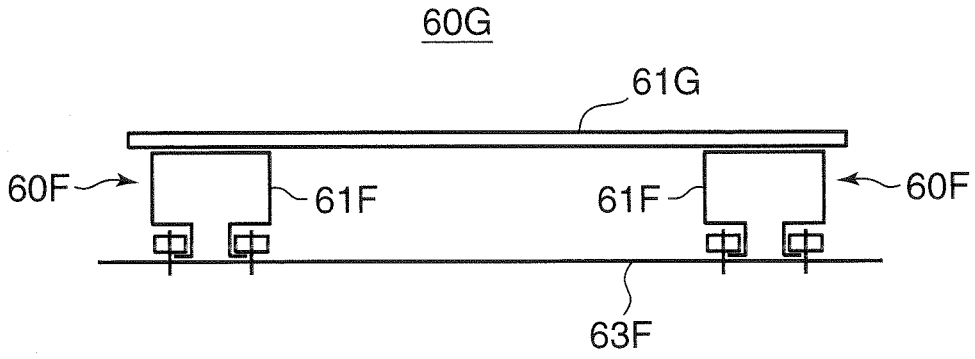

(8) For example, in a case where the drawer mechanism is applied to a large and heavy unit, such as the paper feeding cassettes 122 and 123, in order to ensure a stable pull-out operation, it is preferable to adopt two drawer mechanisms 60 aligned so that the rails become parallel to each other. FIG. 19 is a schematic view showing a drawer mechanism 60G according to a seventh modification. The drawer mechanism 60G is an example where two drawer mechanisms 60F described above are aligned in parallel. A carry plate 61G is mounted on the top plates of the rails 61F of the drawer mechanisms 60F. A unit to be pulled out is mounted on the carry plate 61G. It goes without saying that the rails 61F are attached directly to the bottom surface of the unit by omitting the carry plate 61G.

(9) The embodiment above uses the rail 61 whose cross section is almost in the shape of a capital U. However, it may be configured in such a manner that an inner cavity of the rail 61 is filled with a suitable member.

(10) The drawer mechanism 60 can be provided in any orientation along any of the top, bottom, right, and left directions. For example, by providing the rail on the upper surface of the drum unit and providing the rollers to the frame of the image forming apparatus main body above the drum unit, a drawer mechanism of a pendant type is achieved. Also, it may be configured in such a manner that the rail is provided to the side surface of the discharge unit and the rollers are provided to the frame of the main body on the side of the discharge unit.

(11) The embodiment above described a copying machine as an example of the image forming apparatus. In addition to the copying machine, the invention is applicable to other various types of image forming apparatus, such as a facsimile machine, a printer, and a complex machine thereof. Further, the invention can be applied to various types of apparatus other than an image forming apparatus as long as the apparatus includes an apparatus main body and a unit to be pulled out from the apparatus main body.

The specific embodiments described above chiefly include inventions having the following configurations.

A drawer mechanism according to one aspect of the invention includes: a plate-shaped frame; a first roller and a second roller disposed in a rotatable manner on a surface of the frame at a specific interval, each roller including a guide peripheral surface formed in an outer peripheral portion in a radial direction and a lower surface opposing the surface of the frame at a specific interval; and a rail movable between a first state where the rail is mounted on the surface of the frame and a second state where the rail is pulled out from the frame in a predetermined pull-out direction, the rail including a first pinched portion and a second pinched portion extending linearly in the pull-out direction and pinched between the surface of the frame and one of the lower surfaces and the guide peripheral surfaces of the first roller and the second roller, respectively.

According to this configuration, not only can the rollers make the resistance load smaller when the rail is pulled out, but also they can prevent the rail from falling off in a direction other than the pull-out direction by auxiliary positioning the rail at the time of insertion and guiding the rail. Also, because this configuration does not use an outer rail that has been conventionally used, not only can the number of components and the fabrication man-hours be reduced, but also the apparatus can be reduced in size.

In the configuration described above, it is preferable that the rail includes a first guided surface and a second guided surface extending linearly in the pull-out direction; the first guided surface and the second guided surface abut on the guide peripheral surfaces of the first roller and the second roller, respectively; and the first pinched portion and the second pinched portion are pinched between the surface of the frame and the lower surfaces of the first roller and the second roller, respectively.

According to this configuration, the first pinched portion and the second pinched portion are pinched with the lower surfaces of the first roller and the second roller, respectively, while the first guided surface and the second guided surface provided separately from the first pinched portion and the second pinched portion are guided by the guide peripheral surfaces of the first roller and the second roller, respectively. It is thus possible to guide the rail in a stable manner.

In this case, it is preferable that the first pinched portion and the second pinched portion are made of strip-shaped members parallel to the surface of the frame, and that the first roller and the second roller are attached to the frame in such a manner that intervals between the surface of the frame and the respective lower surfaces become larger than a thickness of the strip-shaped members. According to this configuration, it is possible to fit the first pinched portion and the second pinched portion into clearances between the lower surfaces of the rollers and the surface of the frame with ease.

In the configuration described above, it is preferable that: the rail is formed of a plate-shaped member having a first side edge portion and a second side edge portion parallel to the pull-out direction; the first side edge portion is provided with the first guided surface and the first pinched portion; and the second side edge portion is provided with the second guided surface and the second pinched portion. According to this configuration, the rail can be of a shape that is simple and easy to pull out.

In this case, it is preferable that at least the first guided surface and the first pinched portion are formed by bending the plate-shaped member, and that the first guided surface is formed by bending the plate-shaped member so as to head in a direction almost perpendicular with respect to the surface of the frame, and the first pinched portion is formed by bending the plate-shaped member so as to further protrude sideways from the first guided surface almost in parallel with the surface of the frame. According to this configuration, the pinched portions and the guided surfaces of the rail can be formed readily by bending a plate-shaped member.

In the configuration described above, it is preferable that at least one of the first pinched portion and the second pinched portion is provided with a notch portion in a rear end portion in the pull-out direction. According to this configuration, it becomes easier to insert the rail between the rollers.

In the configuration described above, it is preferable that the drawer mechanism further includes a first protrusion formed on the surface of the frame, and a second protrusion provided to the rail so as to interfere with the first protrusion. According to this configuration, it is possible to prevent the frame from falling off in the pull-out direction due to interference of the first protrusion and the second protrusion.

In the configuration described above, it is preferable that at least one of the first roller and the second roller is formed of plural roller groups aligned along the pull-out direction. According to this configuration, the rail can be held and guided in a stable manner with the roller groups.

In the configuration described above, it is preferable that the rail has a mount surface on which a certain unit is to be mounted.

In this case, it is preferable that the rail has a guide portion that allows the unit to move by sliding along the pull-out direction. According to this configuration, the unit can be pulled out in two steps, and the entire unit can be pulled out to the outside of the apparatus main body.

An image forming apparatus according to another aspect of the invention includes: an apparatus main body having a housing structure and equipped with a plate-shaped frame; a unit accommodated in the apparatus main body; and a drawer mechanism that allows the unit to be pulled out from the apparatus main body. The drawer mechanism includes: a first roller and a second roller disposed in a rotatable manner on a surface of the frame at a specific interval, each roller including a guide peripheral surface formed in an outer peripheral portion in a radial direction and a lower surface opposing the surface of the frame at a specific interval; and a rail, on which the unit is mounted and which is movable between a first state where the rail is mounted on the surface of the frame within the apparatus main body and a second state where a part of the rail is pulled out from the apparatus main body in a predetermined pull-out direction, the rail including a first pinched portion and a second pinched portion extending linearly in the pull-out direction and pinched between the surface of the frame and one of the lower surfaces and the guide peripheral surfaces of the first roller and the second roller, respectively.

According to this configuration, it is possible to pull out various units included in the image forming apparatus, such as a paper feeding unit, in a more stable manner while making the resistance load during the pull-out operation smaller.

In this case, it is preferable that image forming apparatus further includes: a first protrusion formed on the surface of the frame; a second protrusion provided to the rail so as to interfere with the first protrusion; a guide portion provided to the rail and extending along the pull-out direction; and a guided portion provided to the unit and guided by the guide portion. The guide portion allows the unit to move by sliding in the pull-out direction by a specific first distance with respect to the rail. The first protrusion allows the rail to move by sliding in the pull-out direction by a specific second distance with respect to the frame. A sum of the first distance and the second distance is longer than a length of the unit in the pull-out direction.

According to this configuration, it is possible to pull out the unit entirely to the outside of the apparatus main body. The workability of maintenance and paper jam processing of the image forming apparatus can be thus enhanced.

In the configuration described above, it is preferable that: the rail is formed of a plate-shaped member having a first side edge portion and a second side edge portion parallel to the pull-out direction and a mount surface positioned between the side edge portions, the unit is to be mounted on the mount surface; the first side edge portion is provided with the first guided surface and the first pinched portion; the second edge portion is provided with the second guided surface and the second pinched portion; the guide portion is a guide groove perforated in the mount surface and extending along the pull-out direction; and the guided portion is a pin member fit in the guide groove.

This application is based on Japanese Patent application serial No. 2007-112039 filed in Japan Patent Office on Apr. 20, 2007, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus, comprising:

an apparatus main body having a housing structure and equipped with a plate-shaped frame;

a unit accommodated in the apparatus main body and having a bottom surface; and a drawer mechanism that allows the unit to be pulled out from the apparatus main body in a pull-out direction, wherein the drawer mechanism includes:

a first roller and a second roller disposed in a rotatable manner on a surface of the frame at a specific interval, each roller including a guide peripheral surface formed in an outer peripheral portion in a radial direction and a lower surface opposing the surface of the frame at a specific interval;

a rail having a mount surface on which the bottom surface of the unit is mounted, the rail being movable between a first state where the rail is mounted on the surface of the frame within the apparatus main body and a second state where a part of the rail is pulled out from the apparatus main body in the pull-out direction, the rail including a first pinched portion and a second pinched portion extending linearly in the pull-out direction and pinched between the surface of the frame and one of the lower surfaces and the guide peripheral surfaces of the first roller and the second roller, respectively;

first and second guide grooves perforated in the mount surface of the rail and extending along the pull-out direction;

at least one first pin and at least one second pin protruding from the bottom surface of the unit, the first and second pins being guided respectively along the first and second guide grooves;

a first protrusion formed on the surface of the frame; and a second protrusion provided to the rail so as to interfere with the first protrusion; wherein a first clearance between the surface of the frame and one of the lower surfaces and the guide peripheral surfaces of the first roller and the second roller has a distance to form a second clearance with the first and second pinched portions being pinched therebetween, so that the rail is inclinable diagonally up with respect to the frame, and a protruding length of the second protrusion is set at a length not to interfere with the first protrusion when the rail is inclined diagonally up with respect to the frame.

2. The image forming apparatus according to claim 1, wherein:

the rail includes a first guided surface and a second guided surface extending linearly in the pull-out direction;

the first guided surface and the second guided surface abut on the guide peripheral surfaces of the first roller and the second roller, respectively; and the first pinched portion and the second pinched portion are pinched between the surface of the frame and the lower surfaces of the first roller and the second roller, respectively.

3. The image forming apparatus according to claim 2, wherein:

the first pinched portion and the second pinched portion are made of strip-shaped members parallel to the surface of the frame; and the first roller and the second roller are attached to the frame in such a manner that intervals between the surface of the frame and the respective lower surfaces become larger than a thickness of the strip-shaped members.

4. The image forming apparatus according to claim 2, wherein:

the rail is formed of a plate-shaped member having a first side edge portion and a second side edge portion parallel to the pull-out direction;

the first side edge portion is provided with the first guided surface and the first pinched portion; and the second side edge portion is provided with the second guided surface and the second pinched portion.

5. The image forming apparatus according to claim 4, wherein:

at least the first guided surface and the first pinched portion are formed by bending the plate-shaped member; and the first guided surface is formed by bending the plate-shaped member so as to head in a direction almost perpendicular with respect to the surface of the frame, and the first pinched portion is formed by bending the plate-shaped member so as to further protrude sideways from the first guided surface almost in parallel with the surface of the frame.

6. The image forming apparatus according to claim 1, wherein:

at least one of the first roller and the second roller is formed of plural roller groups aligned along the pull-out direction.

7. The image forming apparatus according to claim 1, further comprising:

a first protrusion formed on the surface of the frame;

a second protrusion provided to the rail so as to interfere with the first protrusion;

wherein:

the first and second guide grooves allows the unit to move by sliding in the pull-out direction by a specific first distance with respect to the rail;

the first protrusion allows the rail to move by sliding in the pull-out direction by a specific second distance with respect to the frame; and a sum of the first distance and the second distance is longer than a length of the unit in the pull-out direction.

8. The image forming apparatus according to claim 1, wherein:

the at least one first pin comprises two first pins at a specific interval in the pull-out direction and the at least one second pin comprises two second pins at the specific interval in the pull-out direction, wherein the intervals of the first and second pins in the pullout direction determine an amount by which the unit can be pulled out from the rail.

* * * * *